US008185263B2

(12) United States Patent
Kalyanam et al.

(10) Patent No.: US 8,185,263 B2
(45) Date of Patent: May 22, 2012

(54) APPARATUS AND METHOD FOR ESTIMATING RESISTANCE PARAMETERS AND WEIGHT OF A TRAIN

(75) Inventors: Krishnamoorthy Kalyanam, Bangalore (IN); Paul K. Houpt, Schenectady, NY (US); Manthram Sivasubramaniam, Bangalore (IN)

(73) Assignee: General Electric Company, Niskayuna, NY (US)

( * ) Notice: Subject to any disclaimer, the term of this patent is extended or adjusted under 35 U.S.C. 154(b) by 736 days.

(21) Appl. No.: 12/277,036

(22) Filed: Nov. 24, 2008

(65) Prior Publication Data

US 2010/0131130 A1 May 27, 2010

(51) Int. Cl.
*G06F 17/00* (2006.01)

(52) U.S. Cl. ..... 701/19; 701/20

(58) Field of Classification Search ..... 701/19–20; 246/1 R, 2 R

See application file for complete search history.

(56) References Cited

U.S. PATENT DOCUMENTS

| | | | | |
|---|---|---|---|---|
| 4,041,283 | A * | 8/1977 | Mosier | 701/20 |
| 4,042,810 | A | 8/1977 | Mosher | |
| 5,332,180 | A * | 7/1994 | Peterson et al. | 246/3 |
| 5,583,769 | A * | 12/1996 | Saitoh | 701/79 |
| 5,744,707 | A | 4/1998 | Kull | |
| 5,862,048 | A * | 1/1999 | Knight | 700/9 |
| 6,580,976 | B1 | 6/2003 | Belcea | |
| 6,853,889 | B2 * | 2/2005 | Cole | 701/19 |
| 2008/0033605 | A1 | 2/2008 | Daum et al. | |
| 2008/0128562 | A1 * | 6/2008 | Kumar et al. | 246/186 |

FOREIGN PATENT DOCUMENTS

| | | | |
|---|---|---|---|
| DE | 10159957 | A1 | 6/2003 |
| EP | 1070649 | A2 | 1/2001 |
| EP | 1136969 | A2 | 9/2001 |
| EP | 1111359 | B1 | 2/2005 |
| WO | WO0249900 | A1 | 6/2002 |

OTHER PUBLICATIONS

PCT International Search Report dated May 21, 2010 and Written Opinion.

Winter et al., "Fahrerassistenz-System", Signal and Draht, vol. 101, No. 10, pp. 6-10, XP001548183, Oct. 1, 2009.

* cited by examiner

*Primary Examiner* — Yonel Beaulieu
(74) *Attorney, Agent, or Firm* — Joseph J. Christian

(57) ABSTRACT

A computer readable storage medium has a sequence of instructions stored thereon, which, when executed by a processor, causes the processor to acquire a plurality of actual train speed measurements from at least one sensor during a journey and acquire a train power parameter corresponding to each of the plurality of actual train speed measurements. The sequence of instructions further causes the processor to estimate a plurality of resistance parameters from the plurality of actual train speed measurements and the corresponding train power parameters.

7 Claims, 2 Drawing Sheets

APPARATUS AND METHOD FOR ESTIMATING RESISTANCE PARAMETERS AND WEIGHT OF A TRAIN

BACKGROUND

1. Technical Field

The invention includes embodiments that relate to the determination of resistance parameters and weight of a train.

2. Discussion of Art

In operating a train having, for example, at least one vehicle providing power to move the train and a plurality of vehicles to be pulled or pushed by the power vehicle(s), some of the factors that an operator or driving system may take into account include environmental conditions, grade or slope, track or path curvature, speed limits, vehicle size, vehicle configuration, an amount of power able to be supplied by the power vehicles, weight of the train and the cargo, and the desired route and schedule for a journey.

Existing train navigation systems assume perfect knowledge of a number of the above-described operating factors and use preset estimates of the train weight and other train resistance parameters in train navigation models to control the train power. However, operating a train using a static estimate of these train parameters may lead to excess fuel consumption and inaccurate speed regulation, potentially causing the train to violate speed limits. Thus, a navigation system capable of operating the train or assisting the vehicle operator may benefit from a real time estimation of resistance parameters and weight of a train during a journey or trip. Such parameter estimates may be used to increase the accuracy of the train navigation model.

It may be desirable to have a system that has aspects and features that differ from those systems that are currently available. It may be desirable to have a method that differs from those methods that are currently available.

BRIEF DESCRIPTION

Embodiments of the invention provide a computer readable storage medium having a sequence of instructions stored thereon, which, when executed by a processor, causes the processor to acquire a plurality of actual train speed measurements from at least one sensor during a journey and acquire a train power parameter corresponding to each of the plurality of actual train speed measurements. The sequence of instructions further causes the processor to estimate a plurality of resistance parameters from the plurality of actual train speed measurements and the corresponding train power parameters.

Embodiments of the invention also provide a method, which includes the steps of monitoring train operating conditions, estimating a plurality of resistance coefficients based on the monitored train operating conditions, accessing a trip database, and updating a train operation model based on the train operating conditions, the estimated plurality of resistance coefficients, and the trip database.

Embodiments of the invention also provide a system, which includes a plurality of vehicles coupled together and a computer disposed within one of the plurality of vehicles. The computer includes one or more processors configured to track a trip schedule, monitor an operating speed of at least one of the plurality of vehicles, estimate a train weight, estimate a plurality of train resistance parameters, and update a navigation model based on the trip schedule, operating speed, train weight, and train resistance parameters.

Various other features will be apparent from the following detailed description and the drawings.

BRIEF DESCRIPTION OF THE DRAWINGS

The drawings illustrate embodiments contemplated for carrying out the invention. For ease of illustration, a train powered by locomotives has been identified, but other vehicles and train types are included except were language or context indicates otherwise.

DETAILED DESCRIPTION

The invention includes embodiments that relate to navigation systems. The invention also includes embodiments that relate to estimation of train parameters. The invention includes embodiments that relate to methods for estimating of train parameters.

According to one embodiment of the invention, a computer readable storage medium has a sequence of instructions stored thereon, which, when executed by a processor, causes the processor to acquire a plurality of actual train speed measurements from at least one sensor during a journey and acquire a train power parameter corresponding to each of the plurality of actual train speed measurements. The sequence of instructions further causes the processor to estimate a plurality of resistance parameters from the plurality of actual train speed measurements and the corresponding train power parameters.

According to one embodiment of the invention, a method includes the steps of monitoring train operating conditions, estimating a plurality of resistance coefficients based on the monitored train operating conditions, accessing a trip database, and updating a train operation model based on the train operating conditions, the estimated plurality of resistance coefficients, and the trip database.

According to one embodiment of the invention, a system includes a plurality of vehicles coupled together and a computer disposed within one of the plurality of vehicles. The computer includes one or more processors configured to track a trip schedule, monitor an operating speed of at least one of the plurality of vehicles, estimate a train weight, estimate a plurality of train resistance parameters, and update a navigation model based on the trip schedule, operating speed, train weight, and train resistance parameters.

Figure 1:
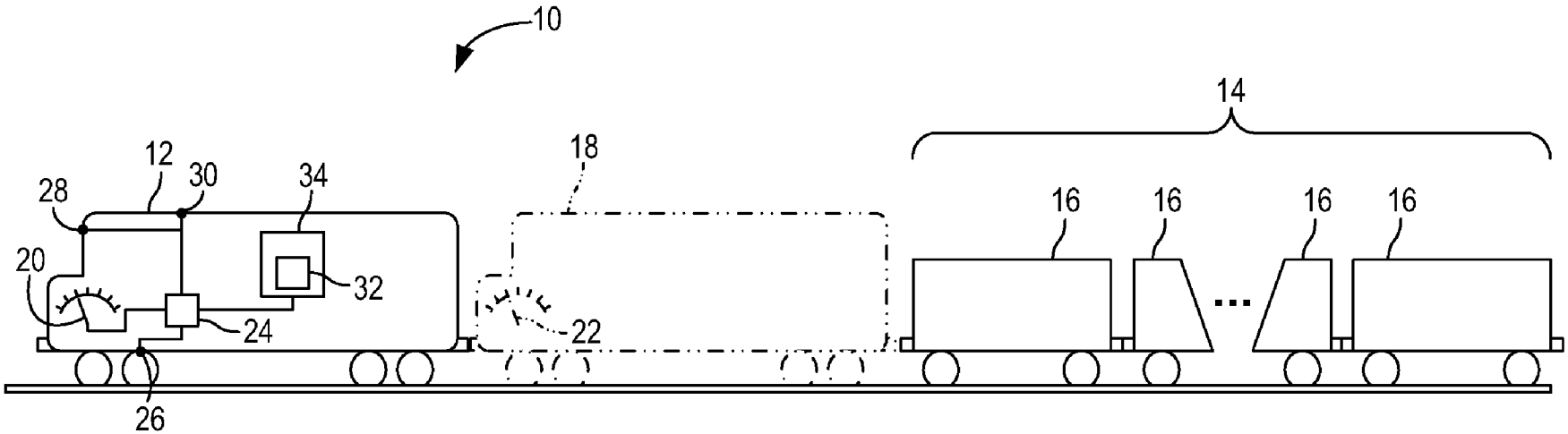
FIG. 1 is an illustration showing a train with a navigation system according to an embodiment of the invention.

FIG. 1 shows a train with a navigation system according to an embodiment of the invention. A train 10 includes at least one primary vehicle 12 that provides tractive effort or power to push or pull a consist 14 made up of a plurality of individual cars 16. In an embodiment of the invention, vehicle 12 is a railroad or freight locomotive; however, other vehicles and train types are contemplated. The number of locomotives 12 in train 10 may vary depending on, for example, the number of cars or vehicles 16 and the load they are carrying. As shown, train 10 includes one locomotive 12. However, as shown in phantom, one or more additional locomotives, for example locomotive 18, may be included. Cars 16 may be any of a number of different types of cars for carrying freight or passengers.

In one embodiment, one of the locomotives, for example locomotive 12, is a master or command vehicle, and any remaining locomotives, for example optional locomotive 18, are slave or trail vehicles. However, it is contemplated that any of the plurality of primary vehicles 12 and 18 may be the command vehicle from which the remaining trail locomotives receive commands. In this manner, an operator, engineer or vehicle navigation system may control the set of locomotives 12 and 18 by controlling the command vehicle. For example, the operator or vehicle navigation system may set a throttle 20 of the master locomotive 12 to a first notch position, causing the throttle 22 of the trail vehicle 18 to move to the first notch position accordingly.

According to an embodiment of the invention, lead locomotive 12 includes a sensor system 24 connected to a number of sensors 26, 28, 30 configured to collect data related to operation of the train 10. According to an exemplary embodiment of the invention, sensor 26 may be configured to collect data corresponding to an actual speed of the train 10, sensor 28 may be configured to collect wind speed data and/or data related to other environmental conditions, and sensor 30 may be configured to collect positional data. According to one embodiment, sensor 30 may be, for example, part of a global positioning system. It is contemplated that additional sensors may be positioned either on or within the train 10 to collect other data of interest, including, for example, the tractive effort or horsepower of lead locomotive 12. Values or parameters measured via sensor system 24 are input and read by a computer 32 configured to operate train 10 according to a plan determined in part by the estimated resistance parameters and weight of the train 10 as discussed in greater detail below. The estimates of the resistance parameters or Davis parameters may represent estimates of journal friction, a rolling resistance of an axle of the train 10, and wind resistance based on the geometry of the train 10. In an embodiment, computer 32 is part of a navigation system 34 configured to operate train 10 according to a train control model. As discussed in detail below, the train control model is derived in part using the estimates of the resistance parameters and the weight of the train 10.

Motion for the train 10, assuming the train 10 is a point mass, may be approximated using a point mass model of the form:

$$\dot{v} = \frac{P}{v}\alpha - (a + bv + cv^2) - g, \qquad \text{(Eqn. 1)}$$

where $\alpha$ represents the inverse of the weight M of the train 10. The engine power P and the train speed v represent the input and output of the system, respectively. Davis model parameters a, b, and c represent resistive coefficients resulting from resistive forces acting on the train 10, and g represents contributions due to grade or gradient.

By introducing the variables $x_1=v$ to indicate the actual train speed and $x_2=P$ to indicate the train power, nonlinear system dynamics are set forth of the form:

$$\dot{x}_1 = f(x_1, x_2)\theta - g$$

$$\dot{x}_2 = u \qquad \text{(Eqn. 2)},$$

where $\theta$ is a vector of the form $\theta=[\alpha\ a\ b\ c]'$ that represents the unknown but constant resistance parameters and $f(x_1,x_2)$ is a nonlinear vector function of the form $$f(x_1, x_2) = \left[\frac{x_2}{x_1} - 1 - x_1 - x_1^2\right].$$

The estimate of the unknown model parameters, represented by $\hat{\theta}$, is introduced by a second change of variables of the form:

$$\xi_1 = x_1$$

$$\xi_2 = f\hat{\theta} - g \qquad \text{(Eqn. 3)},$$

where $\hat{\theta}$ is a vector of the form $\hat{\theta}=[\hat{\alpha}\ \hat{a}\ \hat{b}\ \hat{c}]'$ and $\hat{\alpha}$, $\hat{a}$, $\hat{b}$, and $\hat{c}$ represent the estimate of the resistance parameters $\alpha$, a, b, and c respectively. The time derivative of Eqn. 3 thus yields:

$$\begin{aligned}\dot{\xi}_1 &= \xi_2 + f(\theta - \hat{\theta}) \\ &= \xi_2 + f\tilde{\theta} \\ \dot{\xi}_2 &= \dot{f}\hat{\theta} + f\dot{\hat{\theta}} - \dot{g} \\ &= \left(\frac{\partial f}{\partial \xi_1}\dot{\xi}_1 + \frac{\partial f}{\partial x_2}u\right)\hat{\theta} + f\dot{\hat{\theta}} - \dot{g} \\ &= \frac{\partial f}{\partial \xi_1}\hat{\theta}\dot{\xi}_1 + \frac{\hat{\alpha}}{\xi_1}u + f\dot{\hat{\theta}} - \dot{g},\end{aligned} \qquad \text{(Eqn. 4)}$$

where $\dot{\xi}_1$, $\dot{\xi}_2$, $\dot{f}$, $\dot{g}$, and $\dot{\hat{\theta}}$ represent the time derivatives of $\xi_1$, $\xi_2$, f, g, and $\hat{\theta}$, respectively.

A linearizing feedback control law of the form:

$$\frac{\hat{\alpha}}{\xi_1}u = p_2(z - \xi_1) - \left(p_1 + \frac{\partial f}{\partial \xi_1}\hat{\theta}\right)\dot{\xi}_1 - f\dot{\hat{\theta}}, \qquad \text{(Eqn. 5)}$$

is chosen, where z represents the desired train speed, $p_1$ represents a first proportional-integral (PI) gain input, and $p_2$ represents a second PI gain input. Eqns. 4 and 5 are then combined to form a closed loop system dynamic:

$$\begin{aligned}\dot{\xi} &= \begin{bmatrix} 0 & 1 \\ -p_2 & -p_1 \end{bmatrix}\xi + \begin{bmatrix} 1 \\ -p_1 \end{bmatrix} f\tilde{\theta} + \begin{bmatrix} 0 \\ p_2 \end{bmatrix} z \\ &= A\xi + B\tilde{\theta} + \begin{bmatrix} 0 \\ p_2 \end{bmatrix} z,\end{aligned} \qquad \text{(Eqn. 6)}$$

where $$\xi = \begin{bmatrix} \xi_1 \\ \xi_2 \end{bmatrix},$$

A represents the matrix $$\begin{bmatrix} 0 & 1 \\ -p_2 & -p_1 \end{bmatrix},$$

B represents the vector $$\begin{bmatrix} 1 \\ -p_1 \end{bmatrix},$$

and $\tilde{\theta}=\theta-\hat{\theta}$ represents the difference between the unknown but constant resistance parameters and the estimates of the resistance parameters.

The closed loop system dynamic is associated with the transfer function from z to $\xi_1$ of the form:

$$G_{z\to\xi_1} = \frac{p_2}{s^2 + p_1 s + p_2}, \quad \text{(Eqn. 7)}$$

where s represents the Laplace variable. Eqn. 7 may be represented in state space form by:

$$\dot{\xi}_m = A\xi_m + \begin{bmatrix} 0 \\ p_2 \end{bmatrix} z, \quad \text{(Eqn. 8)}$$

where $\xi_m$ represents the state vector for the model.

The error vector is then defined as:

$$e=\xi-\xi_m \quad \text{(Eqn. 9),}$$

and is governed by:

$$\dot{e}=Ae+B\tilde{\theta} \quad \text{(Eqn. 10).}$$

The PI gain inputs, $p_1$ and $p_2$, are both defined as being greater than zero to create a stable system matrix A. Positive definite matrix Q is also determined, such that:

$$A'Q+QA=-I \quad \text{(Eqn. 11),}$$

where I represents the identity matrix.

Returning to Eqn. 5 and expanding the term $$\frac{\partial f}{\partial \xi_1}\hat{\theta}$$

results in:

$$\frac{\hat{\alpha}}{\xi_1}u - \frac{\hat{\alpha}P}{\xi_1^2}\dot{\xi}_1 = p_2(z-\xi_1) - (p_1 - \hat{b} - 2\hat{c}\xi_1)\dot{\xi}_1 - f\dot{\hat{\theta}}, \quad \text{(Eqn. 12)}$$

and integrating both sides and returning the original variables yields:

$$P=\hat{M}v(p_2\int(z-v)ds-(p_1-\hat{b}-\hat{c}v)v-\int f\dot{\hat{\theta}}ds) \quad \text{(Eqn. 13).}$$

Finally, by assuming $p_1-\hat{b}-\hat{c}v\neq p_1$, an update law for the parameter estimates is derived of the form:

$$P=\hat{M}v(p_2\int(z-v)ds-p_1v-\int f\tilde{\theta}ds) \quad \text{(Eqn. 14).}$$

Thus, Eqn. 14 is a variable gain scheduled PI controller with the additional contribution from $f\tilde{\theta}$. When P is chosen as the control input as opposed to u, Eqn. 14 does not require the train acceleration $\dot{v}$.

Next, an update law is derived for the resistance parameter estimates that will ensure that both the resistance parameter estimation error $\tilde{\theta}$ and the speed error, which represents the difference between the desired train speed z and the actual train speed v, converge to zero.

The acceleration fit error $\eta$ is then defined as:

$$\eta=\dot{\xi}_1-\xi_2=f\hat{\theta} \quad \text{(Eqn. 15),}$$

which is derived in part from Eqn. 4. Next, a candidate Lyapunov function of the form:

$$V = \frac{1}{2\gamma}\tilde{\theta}'\tilde{\theta} \quad \text{(Eqn. 16)}$$

$$\Rightarrow \dot{V} = \frac{1}{\gamma}\tilde{\theta}'\dot{\tilde{\theta}},$$

is tested for convergence, where $\gamma$ is a gain parameter that is chosen to determine the rate of parameter update. A parameter update equation is also chosen of the form:

$$\dot{\hat{\theta}} = \gamma f'\eta \quad \text{(Eqn. 17)}$$

$$\Rightarrow \dot{V} = -\tilde{\theta}' f' f\tilde{\theta} = -\eta^2.$$

The Lyapunov function of Eqn. 16 is negative as long as $\eta$ is not equal to zero. Since V is greater than or equal to zero, the fit error $\eta$ will necessarily go to zero.

Eqn. 15 and Eqn. 17 may be combined to form:

$$\dot{\tilde{\theta}}=-\dot{\hat{\theta}}=-\gamma f'f\tilde{\theta} \quad \text{(Eqn. 18).}$$

Eqn. 18 satisfies the parameter convergence condition that the parameter estimation error $\tilde{\theta}$ goes to zero. Eqn. 18 also satisfies the convergence condition that the speed error goes to zero. From the speed error dynamics (Eqn. 10), when the input parameter estimation error $\tilde{\theta}$ goes to zero the speed error also goes to zero since A is a stable matrix. Thus, Eqn. 18 satisfies convergence of both the resistance parameter estimation error and the speed error.

The control law becomes:

$$P=\hat{M}v(p_2\int(z-v)ds-p_1v-\gamma\int f'\eta ds) \quad \text{(Eqn. 19).}$$

Next, the actual train speed v is numerically differentiated to determine the train acceleration $\dot{v}$, which is used in both the update equation (Eqn. 17) and the control law (Eqn. 19).

Because the prescribed update method requires numerical differentiation of the actual train speed v, errors are introduced in the system. These errors are particularly prevalent when the train speed signal is noisy. To address this signal noise, the fit error of Eqn. 15 is multiplied by the actual train speed v and redefined as:

$$\eta=v\dot{v}-P\hat{\alpha}+(\hat{a}v+\hat{b}v^2+\hat{c}v^3)+gv \quad \text{(Eqn. 20).}$$

A trapezoidal discretization converts the continuous time equation of Eqn. 20 to:

$$\left(\frac{v_{k+1}+v_k}{2}\right)\left(\frac{v_{k+1}-v_k}{\delta t}\right) - \eta_k = \frac{P_{k+1}\hat{\alpha} - \hat{a}v_{k+1} - \hat{b}v_{k+1}^2 - \hat{c}v_{k+1}^3 - g_{k+1}v_{k+1}}{2} + \frac{P_k\hat{\alpha} - \hat{a}v_k - \hat{b}v_k^2 - \hat{c}v_k^3 - g_k v_k}{2}, \quad \text{(Eqn. 21)}$$

where $\delta t$ represents sampling time. Eqn. 21 is then manipulated as:

$$\frac{v_{k+1}^2 - v_k^2}{\delta t} + g_{k+1}v_{k+1} + g_k v_k = (P_{k+1} + P_k)\hat{\alpha} - (v_{k+1} + v_k)\hat{\alpha} - (v_{k+1}^2 + v_k^2)\hat{b} - (v_{k+1}^3 + v_k^3)\hat{c} + \eta_k. \quad \text{(Eqn. 22)}$$

Collecting all unknowns on one side results in:

$$\lceil P_{k+1} + P_k - v_{k+1} - v_k - v_{k+1}^2 - v_k^2 - v_{k+1}^3 - v_k^3 \rfloor \hat{\theta} = \frac{v_{k+1}^2 - v_k^2}{\delta t} + \eta_k + g_{k+1} v_{k+1} + g_k v_k \Rightarrow \phi_k \hat{\theta} = y_k + \eta_k, \quad \text{(Eqn. 23)}$$

where $\phi_k = \lfloor P_{k+1} + P_k - v_{k+1} - v_k - v_{k+1}^2 - v_k^2 - v_{k+1}^3 - v_k^3 \rfloor$ and $$y_k = \frac{v_{k+1}^2 - v_k^2}{\delta t} + g_{k+1} v_{k+1} + g_k v_k.$$

The n data points are stacked to form a regressor vector $\Phi = [\phi_1 \ldots \phi_n]'$ and an output vector $Y = [y_1 \ldots y_n]'$, resulting in the matrix relation:

$$\Phi\theta = Y + \eta \quad \text{(Eqn. 24).}$$

As before, the estimation problem may be posed as the least squares minimization problem:

$$\min_{\theta} |\eta|^2 = \min_{\theta} (\Phi\theta - Y)'(\Phi\theta - Y), \quad \text{(Eqn. 25)}$$

and with the solution given by:

$$\hat{\theta} = (\Phi'\Phi)^{-1}\Phi' Y \quad \text{(Eqn. 26).}$$

A solution for Eqn. 26 exists if the data matrix has full rank, i.e.

$$\Phi'\Phi > 0 \quad \text{(Eqn. 27).}$$

Eqn. 26 represents a batch least squares solution. Therefore, a recursive least squares form of the form:

$$e_k = y_k - \phi_k \hat{\theta}_{k-1} \quad \text{(Eqn. 28)}$$

$$\Pi_k = \left( I - \frac{\Pi_{k-1}\phi_k' \phi_k}{\lambda + \phi_k \Pi_{k-1} \phi_k'} \right) \frac{\Pi_{k-1}}{\lambda}$$

$$\hat{\theta}_k = \hat{\theta}_{k-1} + \frac{\Pi_{k-1}\phi_k'}{\lambda + \phi_k \Pi_{k-1} \phi_k'} e_k.$$

In Eqn. 28, e denotes the model fit error and I is the identity matrix. The covariance matrix $\Pi$ is initialized to $$\Pi_0 = \frac{1}{\delta} I,$$

where $\delta$ is taken to be a small positive number. The forgetting factor $\lambda$ is chosen such that $0 \ll \lambda \leqq 1$.

Figure 2:
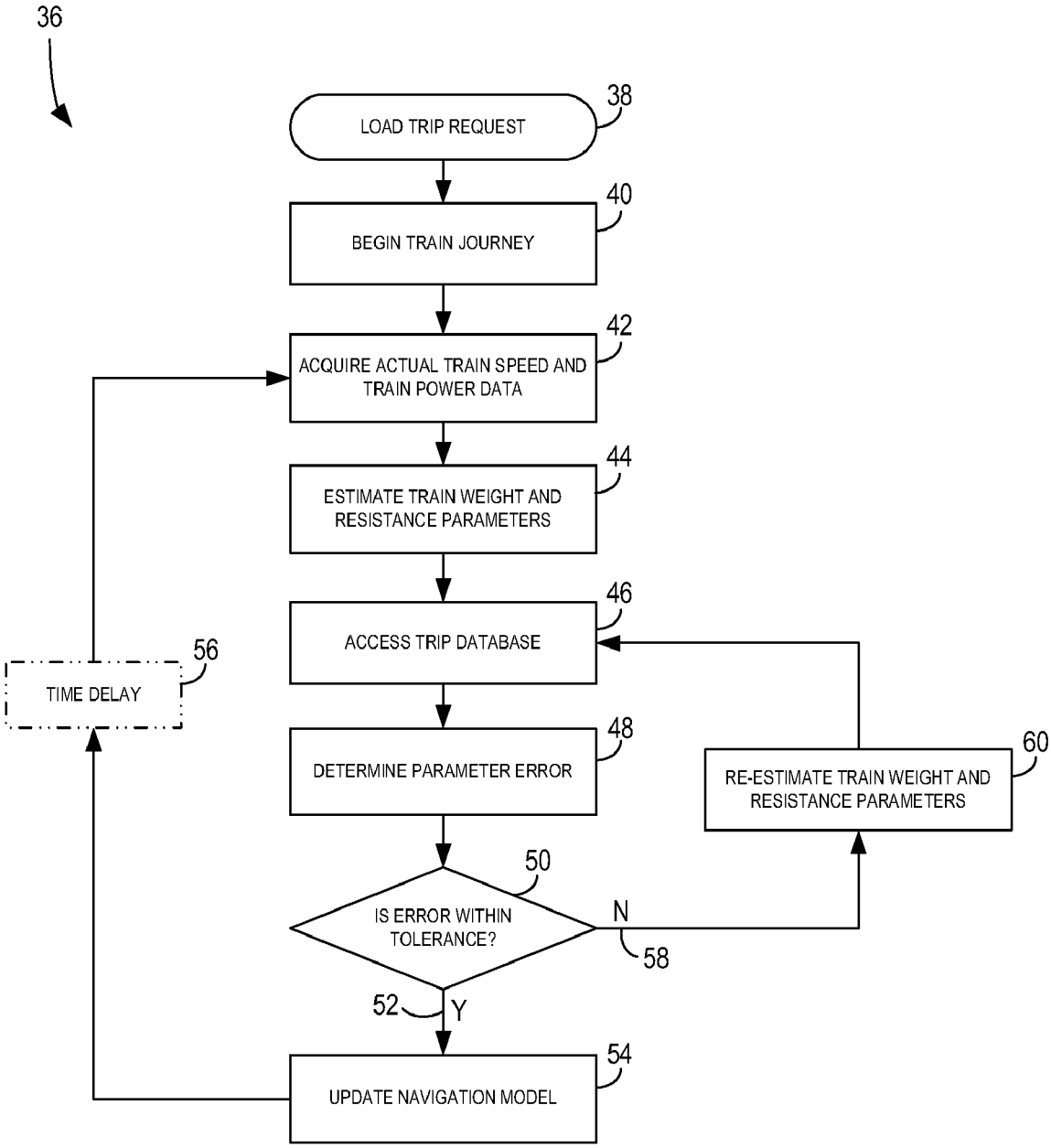
FIG. 2 is a technique for estimating resistance parameters and the weight of a train according to an embodiment of the invention.

According to embodiments of the invention, train speed may be controlled according to a technique 36 as illustrated in FIG. 2. Technique 36 monitors operating conditions of the train 10 of FIG. 1 during a journey and continuously updates a train navigation model based on the monitored operating conditions. According to an exemplary embodiment of the invention, the updated train navigation model optimizes driving commands such as train speed and train power, thus maximizing fuel consumption and minimizing the train speed error.

Technique 36 begins at step 38 by loading a trip request into the navigation system 34 of FIG. 1. The trip request may include such trip information as the trip destination, a desired trip time and/or limits on the trip time, location and duration of stops along the journey, information regarding the train manifest such as load and consist information, route information, speed limits corresponding to the route, and the like. The train journey begins at step 40, after power is applied to the primary locomotive 12 of FIG. 1. At step 42 one or more of the sensors 26, 28, 30 of FIG. 1 acquire data relating to train operating conditions, for example, the actual train speed, train power, and train position. Technique 36 then estimates a train weight and train resistance parameters 44 using the train operating condition data acquired at step 42. At step 46, the trip database is consulted to access trip information, such as a desired train speed, corresponding to the determined position of the train 10.

Technique 36 next uses the actual train speed and power data, estimated train weight and resistance parameters, and the trip information to determine a train resistance parameter error at step 48. At step 50, the train resistance parameter error is analyzed to determine whether it falls within a pre-selected tolerance. If the parameter error does fall within the desired tolerance range 52, the train navigation model is updated at step 54 with the estimates of train weight and train resistance parameters obtained at step 44. Technique 36 then enters an optional time delay 56 before returning to step 42 to reacquire train speed and power data.

If at step 50, the parameter error does not fall within the desired tolerance range 58, technique 36 proceeds to step 60 where new estimates for the train weight and resistance parameters are selected. The trip database is then selected at step 46, and the parameter error of the new parameter estimates is again determined at step 48. If, at step 50, the parameter error is within the selected tolerance 52, the navigation mode is updated at step 54. If not 58, technique 36 continues to cycle through steps 60, 46, 48, and 50 until the parameter error falls within the desired tolerance range.

In this fashion, technique 36 forms a closed-loop system that continuously estimates train model parameters, including train weight and train resistance parameters, in order to update the train navigation model and optimize train power and speed regulation throughout a journey.

A technical contribution for the disclosed method and apparatus is that it provides for a computer-implemented estimation of train resistance parameters and weight of a train.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not limited by the foregoing description, but is only limited by the scope of the appended claims.

What is claimed is:

1. A method comprising:

monitoring train operating conditions;

estimating a plurality of resistance coefficients based on the monitored train operating conditions;

accessing a trip database; and updating a train operation model based on the train operating conditions, the estimated plurality of resistance coefficients, and the trip database.

2. The method of claim 1 wherein monitoring train operating conditions comprises monitoring a train speed and an actual train power.

3. The method of claim 1 wherein updating the train operation model comprises updating a desired train power.

4. The method of claim 1 wherein accessing the trip database comprises determining a desired train speed.

5. The method of claim 1 wherein estimating the plurality of resistance coefficients comprises estimating a train mass and a plurality of Davis coefficients.

6. The method of claim 5 wherein estimating the plurality of Davis coefficients comprises estimating at least one of a journal friction, a frictional coefficient, and a wind resistance.

7. The method of claim 1 wherein estimating the plurality of resistance coefficients comprises implementing a least squares minimization technique.

* * * * *

UNITED STATES PATENT AND TRADEMARK OFFICE

CERTIFICATE OF CORRECTION

PATENT NO. : 8,185,263 B2
APPLICATION NO. : 12/277036
DATED : May 22, 2012
INVENTOR(S) : Kalyanam et al.

It is certified that error appears in the above-identified patent and that said Letters Patent is hereby corrected as shown below:

In Column 4, Line 24, delete " $\hat{\theta}$ " and insert -- $\dot{\hat{\theta}}$ --, therefor.

In Column 5, Line 48, delete " $v-\int f\hat{\theta}ds)$ " and insert -- $v-\int f\dot{\hat{\theta}}ds)$ --, therefor.

In Column 5, Line 49, delete " $p_1-\hat{b}-\hat{c}v\neq p_1$, " and insert -- $p_1-\hat{b}-\hat{c}v\approx p_1$, --, therefor.

In Column 5, Line 52, delete " $v-\int f\tilde{\theta}ds)$ " and insert -- $v-\int f\dot{\tilde{\theta}}ds)$ --, therefor.

In Column 5, Line 54, delete " $f\tilde{\theta}$. " and insert -- $f\dot{\tilde{\theta}}$. --, therefor.

In Column 5, Line 65, delete " $=f\hat{\theta}$ " and insert -- $=f\dot{\hat{\theta}}$ --, therefor.

In Column 6, Line 22, delete " $\tilde{\theta}=-\tilde{\theta}$ " and insert -- $\dot{\tilde{\theta}}=-\dot{\tilde{\theta}}$ --, therefor.

In Column 7, Line 11, delete " $-v_{k+1}^2-v_k^2-v_{k+1}^3-v_k^3]$ " and insert -- $-v_{k+1}^2-v_k^2-v_{k+1}^3-v_k^3]$ --, therefor.

Signed and Sealed this
Nineteenth Day of February, 2013

Teresa Stanek Rea
*Acting Director of the United States Patent and Trademark Office*